US009110486B2

(12) United States Patent
Siegel et al.

(10) Patent No.: US 9,110,486 B2
(45) Date of Patent: Aug. 18, 2015

(54) BANDGAP REFERENCE CIRCUIT WITH STARTUP CIRCUIT AND METHOD OF OPERATION

(75) Inventors: Joshua Siegel, Austin, TX (US); Khoi B. Mai, Austin, TX (US)

(73) Assignee: FREESCALE SEMICONDUCTOR, INC., Austin, TX (US)

( * ) Notice: Subject to any disclaimer, the term of this patent is extended or adjusted under 35 U.S.C. 154(b) by 329 days.

(21) Appl. No.: 13/605,662

(22) Filed: Sep. 6, 2012

(65) Prior Publication Data

US 2014/0062451 A1 Mar. 6, 2014

(51) Int. Cl.
*G05F 3/30* (2006.01)

(52) U.S. Cl.
CPC ..... *G05F 3/30* (2013.01)

(58) Field of Classification Search
CPC ..... G05F 3/30
USPC ..... 327/539, 513; 323/313
See application file for complete search history.

(56) References Cited

U.S. PATENT DOCUMENTS 4,321,562 A * 3/1982 Igarashi ..... 331/116 FE
4,833,342 A * 5/1989 Kiryu et al. ..... 327/541
5,536,977 A * 7/1996 Williams ..... 307/43
5,867,013 A * 2/1999 Yu ..... 323/314
5,939,934 A * 8/1999 So et al. ..... 327/534
6,040,610 A * 3/2000 Noguchi et al. ..... 257/392
6,052,006 A * 4/2000 Talaga et al. ..... 327/143
6,429,726 B1 * 8/2002 Bruneau et al. ..... 327/537
6,784,652 B1 * 8/2004 Aude ..... 323/316
7,113,025 B2 * 9/2006 Washburn ..... 327/539
7,224,209 B2 * 5/2007 Hsu ..... 327/538
7,317,343 B1 * 1/2008 De La Cruz et al. ..... 327/295
7,348,830 B2 3/2008 Debroux
7,911,195 B2 * 3/2011 Draxelmayr ..... 323/313
8,519,755 B2 * 8/2013 Suzuki et al. ..... 327/143
2009/0160531 A1 * 6/2009 Law et al. ..... 327/534

* cited by examiner

*Primary Examiner* — Thomas J Hiltunen
(74) *Attorney, Agent, or Firm* — Joanna G. Chiu; David G. Dolezal

(57) ABSTRACT

A band gap reference circuit including a band gap reference generator having an output for providing a reference voltage and a startup circuit for controlling current provided to the band gap reference generator when activated. The startup circuit includes a turnoff circuit having an output to deactivate the startup circuit to not control current to the band gap reference generator based on a voltage of the output of the band gap reference generator. The turnoff circuit includes an inverter having a first transistor of a first conductivity type in series with a second transistor of a second conductivity type opposite the first conductivity type. The startup circuit includes a body bias circuit connected to a body of the first transistor to provide a voltage differential between the body of the first transistor and a source terminal of the first transistor.

20 Claims, 2 Drawing Sheets

BANDGAP REFERENCE CIRCUIT WITH STARTUP CIRCUIT AND METHOD OF OPERATION

BACKGROUND

1. Field

This disclosure relates generally to a bandgap reference circuit, and more specifically, to a bandgap reference circuit with a startup circuit.

2. Related Art

Bandgap reference circuits are commonly used in integrated circuits to provide a temperature independent bandgap voltage. However, bandgap reference circuits may be unpredictable upon power up. Once powered up, bandgap reference circuits operate at a stable operating point to provide the desired bandgap voltage. However, bandgap reference circuits also typically have a second stable operating point when the current is close to zero which provides an undesirable bandgap voltage (i.e. an erroneous bandgap voltage). Therefore, many bandgap reference circuits include a startup circuit which forces current to start flowing during power-up in order to prevent stabilizing at the undesirable bandgap voltage. However, in order to ensure proper operation of the bandgap reference circuit, the startup circuit needs to be disabled appropriately over a wide range of supply voltages.

BRIEF DESCRIPTION OF THE DRAWINGS

The present invention is illustrated by way of example and is not limited by the accompanying figures, in which like references indicate similar elements. Elements in the figures are illustrated for simplicity and clarity and have not necessarily been drawn to scale.

DETAILED DESCRIPTION

Systems which use a bandgap reference circuit to provide a reliable reference voltage may be powered by a supply voltage, VDD, whose full operating value may be anywhere within a range of full operating values. However, a bandgap reference circuit designed to operate properly assuming that the supply voltage ramps up to the full operating value at the bottom end of the range may not allow for proper operation when the supply voltage ramps up to the top end of the range. Likewise, a bandgap reference circuit designed to operate properly assuming that the supply voltage ramps up to the full operating value at the top end of the range may not allow for proper operation when the supply voltage ramps up to only the bottom end of the range. Therefore, in one embodiment, a bandgap reference circuit is provided which is capable of producing the desired stable reference voltage over a large range of allowable full operating voltages of VDD. In one embodiment, a startup circuit is used to control current to the bandgap reference circuit during the initial ramping up of VDD, but is then disabled after VDD reaches a particular voltage level. This enabling/disabling of the startup circuit may be controlled by one or more series-connected inverters. In one embodiment, the body of a transistor in each of the inverters is biased by a voltage which is a fraction of VDD and varies with VDD. This biasing allows the trip point of each inverter of the one or more inverters to be appropriately varied as VDD varies so as to appropriately enable/disable the startup circuit, regardless of the full operating value reached by VDD. In this manner, the bandgap reference circuit may stabilize at the desired reference voltage over the entire range of full operating values of VDD.

Figure 1:
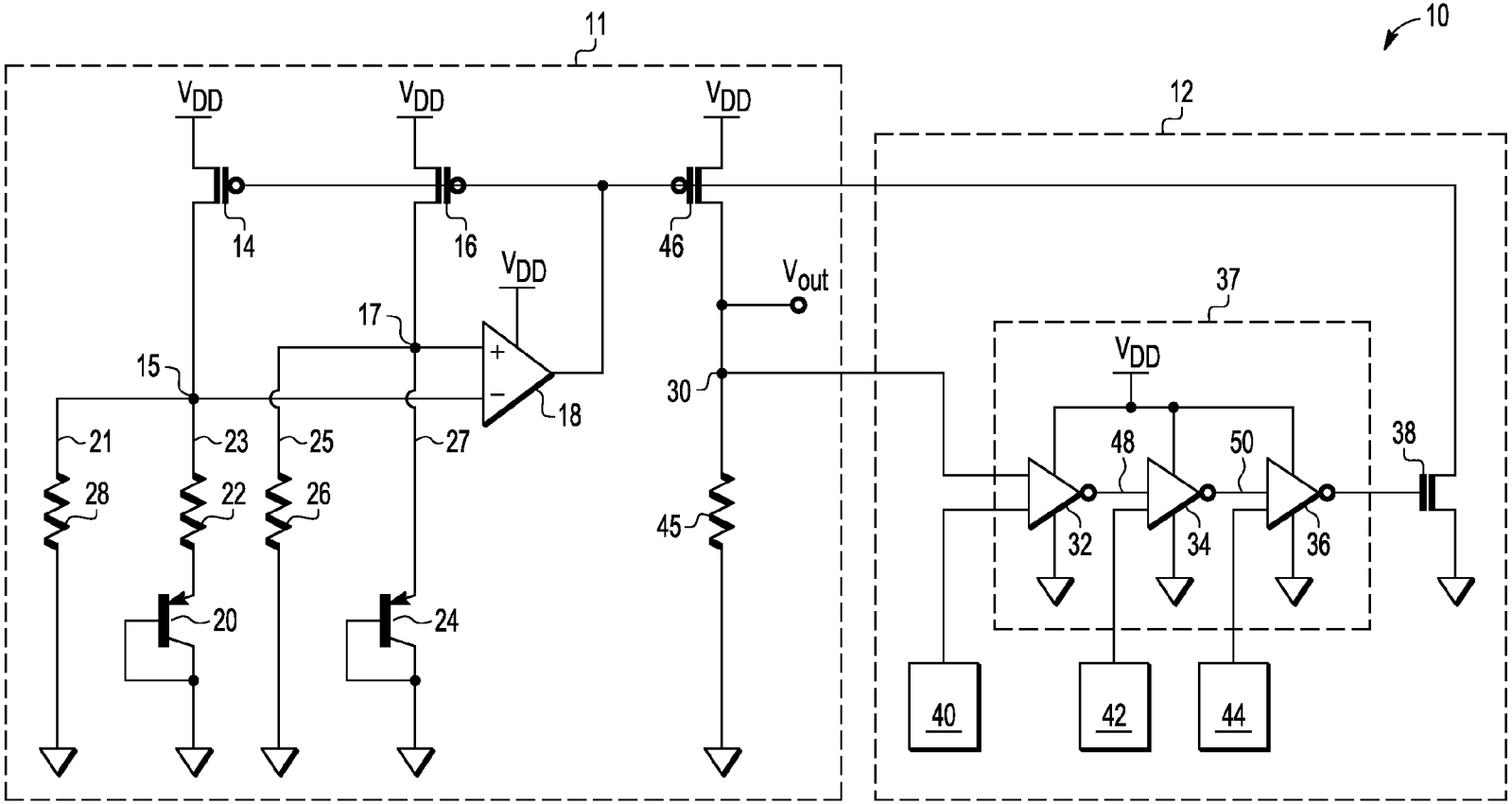
FIG. 1 illustrates, in partial schematic and partial block diagram form, a bandgap reference circuit in accordance with an embodiment of the present disclosure.

FIG. 1 illustrates, in partial schematic and partial block diagram form, a bandgap reference circuit 10 which provides a reference voltage at Vout 30 (note that Vout 30 may also be referred to as node 30). Bandgap reference circuit 10 includes a bandgap generator 11 and a startup circuit 12. Bandgap generator 11 includes an operation amplifier (opamp) 18, P-channel transistors 14, 16, and 46, resistive elements 22, 26, 28, and 45, and bipolar transistors 20 and 24. Transistor 14 has a first current electrode coupled to a first power supply voltage, VDD, and a second current electrode coupled to a circuit node 15. Transistor 16 has a first current electrode coupled to VDD and a second current electrode coupled to a circuit node 17. Opamp 18 has a positive input terminal coupled to node 17, a negative input terminal coupled to node 15, and an output coupled to a control electrode (i.e. gate) of each of transistors 14, 16, and 46. A first terminal of resistive element 28 is coupled to node 15, and a second terminal of resistive element 28 is coupled to ground. The circuit path between node 15 and ground containing resistive element 28 may be referred to as branch 21. A first terminal of resistive element 22 is coupled to node 15, and a second terminal of resistive element 22 is coupled to an emitter of bipolar transistor 20. A collector and base of bipolar transistor 20 are each coupled to ground. The circuit path between node 15 and ground containing resistive element 22 and bipolar transistor 20 may be referred to as branch 23. A first terminal of resistive element 26 is coupled to node 17, and a second terminal of resistive element 26 is coupled to ground. The circuit path between node 17 and ground containing resistive element 26 may be referred to as branch 25. An emitter of bipolar transistor 24 is coupled to node 17, and a collector and base of bipolar transistor 20 are each coupled to ground. The circuit path between node 17 and ground containing bipolar transistor 24 may be referred to as branch 27. A current electrode of transistor 46 is coupled to VDD, and a second current electrode of transistor 46 is coupled to node 30. A first terminal of resistive element 45 is coupled to node 30 and a second terminal of resistive element 45 is coupled to ground. Node 30 and the control electrodes of transistors 14, 16, and 46 are coupled to startup circuit 12. In the illustrated embodiment, bandgap generator 11 is a current mode bandgap generator, and thus includes branches 21 and 25. Note that each of the resistive elements may be implemented as a resistor or as a MOSFET configured as a resistive element.

Startup circuit 12 includes a turnoff circuit 37, an N-channel transistor 38, and body bias circuits 40, 42, and 44. Turnoff circuit 37 includes inverters 32, 34, and 36. Inverter 32 has a signal input coupled to node 30 and a signal output coupled to node 48. Inverter 32 is coupled between VDD and ground and is also coupled to body bias circuit 40. Inverter 34 has a signal input coupled to node 48 and a signal output coupled to node 50. Inverter 34 is coupled between VDD and ground and is also coupled to body bias circuit 42. Inverter 36 has a signal input coupled to node 50 and a signal output coupled to a control electrode (i.e. gate) of transistor 38. Inverter 36 is coupled between VDD and ground and is also coupled to body bias circuit 44. A first current electrode of transistor 38 is coupled to the control electrodes of each of transistors 46, 16, and 14, and a second current electrode of transistor 38 is coupled to ground.

During normal operation, upon reaching a stable operating point, bandgap reference circuit 10 provides a desired reference voltage at Vout 30. Opamp 18 attempts to maintain equal voltages at circuit nodes 15 and 17. In doing so, the output of opamp 18, which detects a voltage differential between nodes 15 and 17, control the gates of transistors 14 and 16 to provide the appropriate currents through transistors 14 and 16 to nodes 15 and 17. These currents flow through resistor 28 of branch 21, resistor 22 and bipolar transistor 20 of branch 23, through resistor 26 of branch 25, and through bipolar transistor 24 of branch 27. During operation at the desirable stable operating point in which opamp 18 maintains equal voltages at 15 and 17, the output of opamp 18 remains stable such that Vout 30 reliably outputs the desired reference voltage. The physical characteristics of the circuit elements within reference generator 11, such as the bandgap of bipolar transistors 20 and 24, determine the value of the reference voltage upon stable operation. In one embodiment, the circuit elements of reference generator 11 are selected such that the value of the desired reference voltage at the stable operating point is 0.95V.

However, as described above, bandgap reference circuit 10 has a second (undesirable) stable operating point which produces an undesired reference voltage which is less than the desired value of 0.95V. For example, this may occur during power up when sufficient voltage has not yet been developed at nodes 15 and 17 such that current only flows through resistors 28 and 26 of branches 21 and 25 and not through branches 23 and 27. Therefore, at this point, no current flows through bipolar transistors 20 and 24. In this case, opamp 18 also attempts to maintain equal voltage at nodes 15 and 17, however, in doing so, the output of opamp 18 remains at an undesirable stable voltage which is lower than the desired stable voltage. This in turn results in Vout being reliably held at a lower voltage value than the desired voltage value. In one embodiment, the undesirable stable value of the reference voltage is 0.7V. This lower undesirable stable value will result in incorrect or unstable of operation of those circuits which receive Vout.

Therefore, during power up, startup circuit 12 may be enabled in which transistor 38 is turned on (by the output of inverter 36), thus pulling the gates of transistors 14 and 16 low. In this manner, transistors 14 and 16 are fully turned on in order to develop sufficient voltage at nodes 15 and 17 to inject current into bipolar transistors 20 and 24. Therefore, when startup circuit 12 is enabled during this first portion of starting up, it controls the current provided from VDD to nodes 15 and 17. However, once sufficient voltage is developed at nodes 15 and 17, startup circuit 12 is disabled (in which transistor 38 is turned off by the output of inverter 36) such that opamp 18 controls transistors 14 and 16 while startup circuit 12 is isolated from transistors 14 and 16. The disabling (or turning off) of transistor 38, and thus the disabling of startup circuit 12, is controlled by inverters 32, 34, and 36 which are coupled between node 30 and the gate of transistor 38. When Vout 30 has hit a level which has surpassed the lower undesirable reference voltage at the second stable operating point (such as 0.7 in the current example), startup circuit 12 may be disabled so that opamp 18 may take control of reaching the desired stable operating point. Therefore, the trip point (i.e. the point at which an inverter changes states) of inverter 32 should be at a level which allows the output of inverter 32 to be low when Vout reaches 0.7 or greater. Similarly, the trip point of inverter 34 should be at a level which allows the output of inverter 34 to be high, and the trip point of inverter 36 should be at a level which allows the output of inverter 36 to be high. In this manner, when the output of inverter 36 goes to its high state, transistor 38 is turned off, thus turning off startup circuit 12 and isolating startup circuit 12 from bandgap generator 11. When startup circuit 12 is disabled, it no longer controls the current provided from VDD to nodes 15 and 17. Instead, the current is controlled by opamp 18. Therefore, startup circuit 12 may initially be activated to prevent bandgap generator 11 from stabilizing at the undesired reference voltage, and upon Vout passing the undesirable reference voltage, startup circuit 12 is deactivated, in which, upon deactivation, the voltages at nodes 15 and 17 are sufficient such that bandgap generator 11 is able to stabilize at the desired reference voltage.

Furthermore, once Vout reaches the desired reference voltage, startup circuit 12 should be maintained deactivated. Therefore, while the trip point of inverter 32 needs to be greater than 0.7 to allow sufficient voltage to develop on nodes 15 and 17, the trip point of inverter needs to be less than the desired reference voltage. If the trip point of inverter 32 is greater than the desired reference voltage, the startup circuit 12 may be reactivated while opamp 18 is stable at the desired reference voltage.

Therefore, it is desirable to set the trip point of inverter 32 to be between the undesired stable reference voltage and the desired stable reference voltage. However, during powerup, the supply voltage, VDD, ramps from 0V to its final operating voltage. However, this final operating voltage may vary in value from system to system. In one embodiment, the final operating voltage may vary between 1.25V and 1.65V. However, in an inverter, such as inverter 32, the P/N ratio may be such that a trip voltage of between 0.7V and 0.95V cannot be achieved at VDD of both 1.25V and 1.65V. For example, the devices of inverter 32 may be sized such that the P/N ratio of the devices at a VDD of 1.25V allows the trip point to appropriately remain between 0.7V and 0.95V; however, these same device sizes will not also allow for an appropriate trip point in the case of VDD being 1.65V. Similarly, the devices of inverter 32 may be sized such that the P/N ratio of the devices at a VDD of 1.65V allows the trip point to be appropriately remain between 0.7V and 0.95V; however, these same device sizes will not also allow for an appropriate trip point when VDD is only 1.25V. Furthermore, from system to system, it is not known a priori to which voltage value within the range of 1.25V and 1.65V that VDD will reach.

As an example, it will be assumed, due to margin considerations, that the trip point of inverter 32 should be between 0.75V and 0.9V (which is more conservative than the exemplary range described above of 0.7V and 0.95V in order to account for the margin considerations). However, as VDD changes, the threshold voltage (VT) of a transistor also changes. Therefore, as VDD changes, the trip point of inverter 32 (which is determined by the threshold voltage) changes. In order to ensure proper operation, though, the trip point of inverter 32 needs to remain between 0.75V and 0.9V. That is, as described above, for proper operation, the trip point of inverter 32 needs to remain between 0.75V and 0.9V regardless of whether VDD ramps to only 1.25V or to 1.65V (or to any value in between). In one embodiment, startup circuit 12 includes a body bias circuit 40 (which may also be referred to as a trip point set circuit) which applies a voltage that is dependent on VDD to the body of the N-channel transistor of inverter 32. This biasing increases as VDD increases which results in lowering the VT of the N-channel transistor as VDD increases. Therefore, as VDD increases, the trip point of inverter 32 also decreases. In this manner, as VDD changes, the trip point of inverter 32 is maintained within the necessary range to ensure proper operation of startup circuit 12 (by properly controlling transistor 38).

In the illustrated example, turnoff circuit 37 includes an odd number of series-connected inverters, including inverters 32, 34, and 36, that are used to control the enabling/disabling of transistor 38 and thus of startup circuit 12. Therefore, inverter 34 may also have a corresponding body bias circuit 42 and inverter 36 may also have a corresponding body bias circuit 44, as will be described below. The body bias circuits (which may also be referred to as trip point set circuits) are connected to bias the body of one of the devices of the corresponding inverter in order to affect the threshold voltage (VT) of that device based on the voltage of VDD, and thus the trip point of the corresponding inverter based on the voltage of VDD. That is, the body bias changes as VDD changes. In one embodiment, body bias circuits 40, 42, and 44 may collectively be referred to as a body bias circuit of startup circuit 12. Furthermore, in the illustrated embodiment, 3 series-connected inverters between node 30 and the gate of transistor 38 are used to control the turning off/on of transistor 38. However, in alternate embodiments, any odd number of inverters may be used (each with a corresponding body bias circuit), including only one inverter, such as only inverter 32 with body bias circuit 40 (in this case, the output of inverter 32 would be coupled to the control electrode of transistor 38). By controlling the turning on/off of transistor 38, turnoff circuit 37 controls activating/deactivating, respectively, of startup circuit 12.

Figure 4:
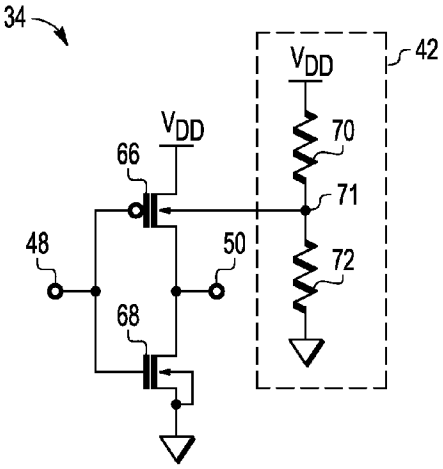
FIG. 4 illustrates, in schematic form, an example of an inverter and body bias circuit of FIG. 1.
Figure 5:
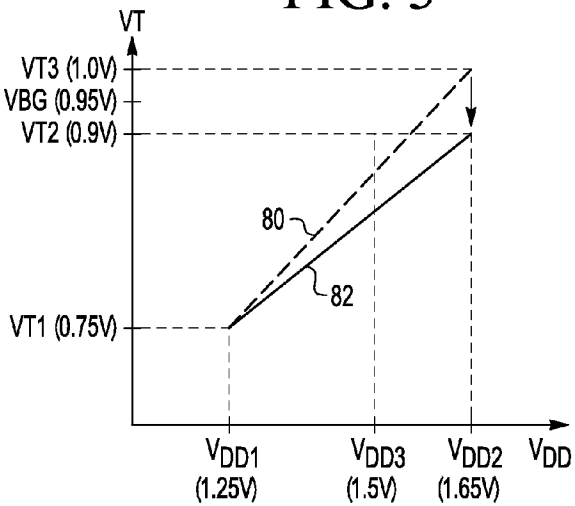
FIG. 5 illustrates, in graphical form, an exemplary representation of the variation of the threshold voltage of a device over a range of supply voltage values.

FIG. 5 provides a graphical representation of a varying threshold voltage (VT), which corresponds to the trip point of the inverter, over a range of VDD values. Dotted line 80 represents the case in which the body of the transistor is tied to the source terminal such that there is no differential between the body and source of the transistors. Solid line 82 represents the case in which the body of the transistors is biased with a voltage that is not the same as the voltage on the source. Furthermore, as will be described in reference to FIGS. 2-4, the body bias voltage may change as VDD changes. Also, as described above, the final operating value of VDD may vary from system to system within a range of VDD1 to VDD2 (e.g. 1.25V to 1.65V in the current example). In the case of dotted line 80, inverter 32 may be designed such that at a VDD value of VDD1 (e.g. 1.25V, the lowest value of the range of the final operating value of VDD) results in a VT of VT1 (e.g. 0.75V), which is greater than or equal to a trip point of 0.75V, as is desired. However, with the same sizing of the transistors in inverter 32, at a VDD value of VDD2 (e.g. 1.65V, the highest value of the range of the final operating value of VDD) results in a VT of VT3 (e.g. 1.0V), which is greater than the desired maximum value of the trip point, 0.95V. That is, in this example, if VDD ramps up to a full 1.65V, the trip point of inverter 32 will be 1.0V, meaning that when Vout reaches its desirable reference voltage of 0.95V, startup circuit 12 will be erroneously enabled. In this example, at a VDD of 1.25V, the ratio of the trip voltage to VDD is 0.75V/1.25V, which equals 0.6. To maintain this ratio, at a voltage of 1.65V, the trip voltage would be 0.6V× 1.65V, which equals about 1V. However, this trip voltage is too high for appropriate operation of bandgap reference circuit 10. Similarly, if the sizing of the transistors is selected for a VDD of 1.65V, then the ratio of the trip voltage to VDD is 0.9V/1.65V, which equals 0.55. However, this ratio, at a VDD of 1.25V, would result in a VT of 1.25V×0.55V, which equals 0.69V, which is too low for appropriate operation of bandgap reference circuit 10 because startup circuit would be disabled too soon, before sufficient voltage develops at nodes 15 and 17. Therefore, note that inverter 32, without body biasing, as is typically done, cannot maintain proper operation over the entire range of allowable final operating values of VDD (e.g. 1.25V to 1.65V). That is, it is desirable to have a bandgap reference circuit which operates properly over an entire range of allowable VDD values by maintaining the trip point of inverter 32 in an appropriate range.

Referring to FIG. 5, in the case of solid line 82, in which inverter 32 has a biased body, regardless of whether VDD reaches 1.25V or 1.65V, the VT (and thus trip point of inverter 32) remains between 0.75V and 0.9V, as needed to appropriately disable startup circuit 12. Therefore, with the biased body in inverter 32, bandgap reference circuit 10 can operate properly over an entire range of allowable VDD values. In one embodiment, a highest voltage of the final operating voltage of VDD is at least 25 percent greater than a lowest voltage of the final operating voltage of VDD.

Figure 3:
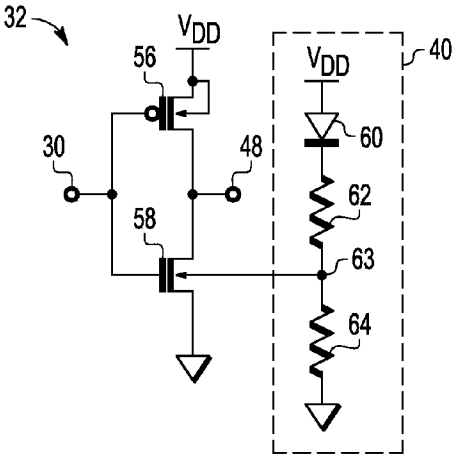
FIG. 3 illustrates, in schematic form, an example of an inverter and body bias circuit of FIG. 1.
Figure 2:
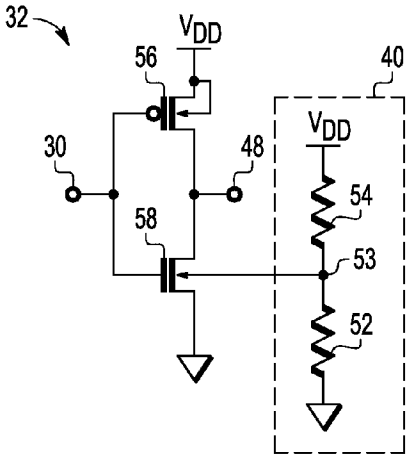
FIG. 2 illustrates, in schematic form, an example of an inverter and body bias circuit of FIG. 1.

FIGS. 2-4 illustrate various examples of an inverter having a corresponding body bias circuit which may be included in startup circuit 12. For example, FIGS. 2 and 3 provide examples of inverter 32 and corresponding body bias circuit 40 connected to the body of the N-channel transistor. However, note that the example circuits of FIGS. 2 and 3 may also be used for inverter 36, or any other inverter within turnoff circuit 37 which requires body biasing of the N-channel transistor. Similarly, FIG. 4 provides an example of inverter 34 and corresponding body bias circuit 42 connected to the body of the P-channel transistor. However, the circuit of FIG. 4 may be used for any inverter within turnoff circuit 37 which requires body biasing of the P-channel transistor.

FIG. 2 illustrates inverter 32 and corresponding body bias circuit 40, in accordance with one embodiment. Inverter 32 includes an P-channel transistor 56 having a first current electrode (e.g. source) connected to VDD, a second current electrode (e.g. drain) connected to circuit node 48 (which provides the output of inverter 32), a control electrode (e.g. gate) connected to circuit node 30 (which provides the input of inverter 32), and a body connected to the first current electrode of transistor 56. Inverter 32 also includes an N-channel transistor 58 having a first current electrode (e.g. drain) connected to node 48, a second current electrode (e.g. source) connected to ground, and a control electrode (e.g. gate) connected to circuit node 30. Body bias circuit 40 is connected to the body of transistor 58. Body bias circuit 40 includes a first resistive element 54 having a first terminal coupled to VDD and a second terminal coupled to a divided voltage node 53, and a second resistive element 52 having a first terminal coupled to divided voltage node 53 and a second terminal coupled to ground. Divided voltage node 53 is connected to the body of transistor 58.

FIG. 3 illustrates inverter 32 and corresponding body bias circuit 40, in accordance with another embodiment. Inverter 32 includes an P-channel transistor 56 and N-channel transistor 58 connected between VDD and ground and to nodes 30 and 48, as described above in FIG. 2. The body of transistor 56 is also connected to the source or transistor 56, as in FIG. 2, and the body of transistor 58 is connected to body bias circuit 40. However, body bias circuit 40 of FIG. 3 includes a diode 60 having an anode coupled to VDD and a cathode coupled to a first terminal of a resistive element 62. A second terminal of resistive element 62 is coupled to a circuit node 63. Body bias circuit 40 includes a second resistive element 64 having a first terminal coupled to node 63 and a second terminal coupled to ground. Circuit node 63, which may also be referred to as a voltage divider node, is connected to the body of transistor 58.

In operation of either embodiment of FIG. 2 or 3, body bias circuit 40 provides a voltage to the body of transistor 58 based on VDD. That is, the voltage on the body of transistor 58 is a fraction of VDD. In one embodiment, the voltage on the body of transistor 58 is in a range of 10 to 90 percent of VDD, or, alternatively, in range of 10 to 50 percent of VDD. Body bias circuit 40 biases the body of transistor 58 to be higher than ground during startup operation of bandgap reference circuit 10. That is, body bias circuit 40 results in a voltage differential between the body and source of transistor 58. Furthermore, the body of transistor 56 is connected to the source of transistor 56. Therefore, body bias circuit 40 biases the body of transistor 58 to be different in voltage than the body of transistor 56. By applying a fraction of VDD to the body of transistor 58, the biasing of the body of transistor 58 increases as VDD increases. This results in lowering the VT of transistor 58 as VDD increases, thus lowering the trip point of inverter 32 as VDD increases. This ensures that the trip point of inverter 32 is maintained in the desirable range. Therefore, during startup, as VDD ramps up from 0V to its final full operating voltage, the trip point of inverter 32 changes as VDD changes.

Referring to FIG. 2, the values of resistors 54 and 52 can be selected such that the voltage at node 53 (and thus on the body of transistor 58) is at the appropriate fraction of VDD, such as in a range of 10 to 90 percent of VDD, or alternatively, in a range of 10 to 50 percent of VDD. Similarly, referring to FIG. 3, the values of resistor 62 and 64 can be selected such that the voltage at node 63 (and thus on the body of transistor 58) is at the appropriate fraction of VDD, such as in a range of 10 to 90 percent of VDD, or alternatively, in a range of 10 to 50 percent of VDD. Furthermore, referring to FIG. 3, diode 60 prevents current from flowing until VDD reaches at least 0.7 volts. In this manner, the trip point of inverter 32 does not get lowered in the lower VDD range because body bias circuit 40 does not operate until VDD reaches at least 0.7 volts (in addition to any voltage over the resistor). Therefore, in the embodiment of FIG. 3, the trip point of inverter 32 is not adjusted and low voltage values of VDD. In this manner, the minimum desired trip point (0.75V, in the examples provided above) is not affected by body bias circuit 40, and instead, body bias circuit 40 lowers the trip point at higher voltage values of VDD to ensure that it stays below the maximum desired trip point (0.95V, in the examples provided above). Furthermore, any number of diodes may be used in addition to diode 60 to further affect when body bias circuit 40 comes into effect. Therefore, note that a variety of different circuit configurations may be used to apply a bias voltage to the body of the N-channel transistor of inverter 32 and/or inverter 36 that is a fraction of VDD and which varies as VDD varies.

FIG. 4 illustrates inverter 34 and corresponding body bias circuit 42, in accordance with one embodiment. Inverter 34 includes an P-channel transistor 66 having a first current electrode (e.g. source) connected to VDD, a second current electrode (e.g. drain) connected to circuit node 50 (which provides the output of inverter 34), a control electrode (e.g. gate) connected to circuit node 48 (which provides the input of inverter 34), and a body connected to body bias circuit 42. Inverter 34 also includes an N-channel transistor 68 having a first current electrode (e.g. drain) connected to node 50, a second current electrode (e.g. source) connected to ground, a control electrode (e.g. gate) connected to circuit node 48, and a body connected to the second current electrode of transistor 68. Body bias circuit 42 includes a first resistive element 70 having a first terminal coupled to VDD and a second terminal coupled to a divided voltage node 71, and a second resistive element 72 having a first terminal coupled to divided voltage node 71 and a second terminal coupled to ground. Divided voltage node 71 is connected to the body of transistor 66.

In operation, body bias circuit 42 provides a voltage to the body of transistor 66 based on VDD. That is, the voltage on the body of transistor 66 is a fraction of VDD. In one embodiment, the voltage on the body of transistor 66 is in a range of 10 to 90 percent of VDD, or, alternatively, in range of 50 to 90 percent of VDD. Body bias circuit 42 biases the body of transistor 66 to be lower than VDD during startup operation of bandgap reference circuit 10. That is, body bias circuit 42 results in a voltage differential between the body and source of transistor 66. Furthermore, the body of transistor 68 is connected to the source of transistor 68. Therefore, body bias circuit 42 biases the body of transistor 68 to be different in voltage than the body of transistor 66. By applying a fraction of VDD to the body of transistor 66, the biasing of the body of transistor 66 decreases as VDD increases. This results in reducing the VT of transistor 66 as VDD increases, thus raising the trip point of inverter 34 as VDD increases. This ensures that the trip point of inverter 34 is maintained in the desirable range which is compatible with the output of inverter 32 to appropriately control inverter 36 so that transistor 38 can be enabled/disabled appropriately. Therefore, during startup, as VDD ramps up from 0V to its final full operating voltage, the trip point of inverter 36 changes as VDD changes. The values of resistors 70 and 72 can be selected such that the voltage at node 71 (and thus on the body of transistor 66) is at the appropriate fraction of VDD, such as in a range of 10 to 90 percent of VDD, or alternatively, in a range of 50 to 90 percent of VDD. Therefore, note that a variety of different circuit configurations may be used. Furthermore, as described in reference to FIG. 3, diodes may also be used in body bias circuit 42. By using one or more diodes, body bias circuit 42 can increases the trip point of inverter 34 at the higher voltage values of VDD, thereby lowering the effective trip point of inverter 32 from the perspective of the gate of transistor 38. The diode(s) would be placed between resistors 70 and 72 and node 71 would be node between resistor 70 and the diode(s).

Alternate embodiments of body bias circuits 40 and 42 can have different combinations of resistive elements and diodes to achieve the proper biasing to ensure that the trip point of the corresponding inverter varies appropriately with VDD in order to stay within the allowable range of trip points for proper disabling/enabling of startup circuit 12. Furthermore, the resistive elements and diodes can each be implemented in a variety of different ways. For example, the resistive elements may be implemented as resistors. Also, a MOSFET can be used as a resistive element or a diode, based on how it is configured. Also, in alternate embodiments, only one inverter, such as inverter 32, has a corresponding body bias circuit.

In the embodiments of FIGS. 1-4, an n-type bandgap reference circuit is illustrated. However, one of ordinary skill in the art can appreciate that bandgap reference circuit 10 may be a p-type bandgap reference circuit in which transistor 38 is a P-channel transistor. In this embodiment, turnoff circuit 37 would still include an odd number of inverters, and the body bias circuits would still control the trip points of the corresponding inverter so as to ensure that the startup circuit is appropriately enabled/disabled.

By now it should be appreciated that there has been provided a bandgap reference circuit which is capable of producing the desired stable reference voltage over a large range of allowable full operating voltages of VDD. By biasing the body of a transistor of an inverter in the turnoff circuit (which operates to enable/disable the startup circuit) with a voltage that is a fraction of VDD and that varies with VDD, the trip point of the inverter can be ensured to remain within an allowable range of trip point voltages. This ensures the proper turning on and off of the startup circuit so as to prevent the bandgap circuit from stabilizing at the undesirable stable value, regardless of the final operating voltage of VDD.

Because the apparatus implementing the present invention is, for the most part, composed of electronic components and circuits known to those skilled in the art, circuit details will not be explained in any greater extent than that considered necessary as illustrated above, for the understanding and appreciation of the underlying concepts of the present invention and in order not to obfuscate or distract from the teachings of the present invention.

Although the invention has been described with respect to specific conductivity types or polarity of potentials, skilled artisans appreciate that conductivity types and polarities of potentials may be reversed.

Moreover, the terms "front," "back," "top," "bottom," "over," "under" and the like in the description and in the claims, if any, are used for descriptive purposes and not necessarily for describing permanent relative positions. It is understood that the terms so used are interchangeable under appropriate circumstances such that the embodiments of the invention described herein are, for example, capable of operation in other orientations than those illustrated or otherwise described herein.

Although the invention is described herein with reference to specific embodiments, various modifications and changes can be made without departing from the scope of the present invention as set forth in the claims below. For example, turnoff circuit 37 may include any odd number of inverters, and each inverter may have a corresponding body bias circuit. Accordingly, the specification and figures are to be regarded in an illustrative rather than a restrictive sense, and all such modifications are intended to be included within the scope of the present invention. Any benefits, advantages, or solutions to problems that are described herein with regard to specific embodiments are not intended to be construed as a critical, required, or essential feature or element of any or all the claims.

The term "coupled," as used herein, is not intended to be limited to a direct coupling or a mechanical coupling.

Furthermore, the terms "a" or "an," as used herein, are defined as one or more than one. Also, the use of introductory phrases such as "at least one" and "one or more" in the claims should not be construed to imply that the introduction of another claim element by the indefinite articles "a" or "an" limits any particular claim containing such introduced claim element to inventions containing only one such element, even when the same claim includes the introductory phrases "one or more" or "at least one" and indefinite articles such as "a" or "an." The same holds true for the use of definite articles.

Unless stated otherwise, terms such as "first" and "second" are used to arbitrarily distinguish between the elements such terms describe. Thus, these terms are not necessarily intended to indicate temporal or other prioritization of such elements.

The following are various embodiments of the present invention.

Item 1 includes a band gap reference circuit including a band gap reference generator including an output for providing a reference voltage; a startup circuit for controlling current provided to the band gap reference generator when activated, wherein the startup circuit includes: a turnoff circuit having an output to deactivate the startup circuit to not control current to the band gap reference generator based on a voltage of the output of the band gap reference generator, the turnoff circuit including an inverter having a first transistor of a first conductivity type in series with a second transistor of a second conductivity type opposite the first conductivity type; and a body bias circuit connected to a body of the first transistor to provide a voltage differential between the body of the first transistor and a source terminal of the first transistor. Item 2 includes the circuit of item 1 wherein the first transistor is an N-channel transistor having its source coupled to a ground terminal, wherein the body bias circuit is configured to bias the body of the first transistor to be higher than ground during a startup operation of the band gap reference circuit. Item 3 includes the circuit of item 1 wherein the first transistor is a P-channel transistor having its source coupled to a power supply voltage terminal, wherein the body bias circuit is configured to bias the body of the first transistor to be lower than the power supply voltage terminal during a startup operation of the band gap reference circuit. Item 4 includes the circuit of item 1 wherein the body bias circuit biases the body of the first transistor to be different in voltage than a body of the second transistor. Item 5 includes the circuit of item 1 wherein the body bias circuit includes a voltage divider coupled between a power supply voltage terminal and a ground terminal, the voltage divider includes a divided voltage node coupled to the body of the first transistor. Item 6 includes the circuit of item 5 wherein the voltage divider includes a diode coupled between the divided voltage node and one of the power supply terminal and ground terminal. Item 7 includes the circuit of item 1 wherein a body of the second transistor is connected to a source of the second transistor. Item 8 includes the circuit of item 1 wherein the first transistor and a second transistor are coupled in series between a power supply terminal and a ground terminal, wherein the body bias circuit is configured to bias the body of the first transistor to be in a range of 10-90% of a voltage of the power supply terminal. Item 9 includes the circuit of item 1 wherein the first transistor and a second transistor are coupled in series between a power supply terminal and a ground terminal, wherein the body bias circuit is configured to bias the body of the first transistor to be in a range of 10-50% of the voltage of the power supply terminal. Item 10 includes the circuit of item 1 wherein the turnoff circuit includes a second inverter and a third inverter connected in series with the inverter, wherein an output of a last of the inverter, the second inverter, and the third inverter connected in the series is connected to the output of the turnoff circuit. Item 11 includes the circuit of item 10 wherein the body bias circuit is connected to a body of a third transistor of the second inverter to provide a voltage differential between the body of the third transistor and a source terminal of the third transistor. Item 12 includes the circuit of item 11 wherein the first transistor is an N-channel transistor and the third transistor is a P-channel transistor. Item 13 includes the circuit of item 12 wherein a body of the second transistor is connected to a source of the second transistor and a body of a fourth transistor of the second inverter is connected to a source of the fourth transistor, the fourth transistor is coupled in series with the third transistor. Item 14 includes the circuit of item 1 wherein the startup circuit, when activated, controls current provided to the band gap reference generator from a power supply terminal; the startup circuit is configured for the band gap reference circuit to be operable over a range of power supply terminal voltages of the power supply terminal; and for each power supply terminal voltage within the range of power supply terminal voltages, the band gap reference generator is configured to provide at its output a stable reference voltage at a first voltage and at a second voltage greater than the first voltage, wherein the body bias circuit is configured to bias the body of the first transistor such that the startup circuit remains activated during a startup of the band gap reference circuit as the voltage of the output of the band gap reference generator rises through the first voltage and the start up circuit deactivates after the voltage of the output of the band gap reference generator is greater than the first voltage and remains deactivated as the voltage of the output reaches the second voltage. Item 15 includes the circuit of item 14 wherein a higher voltage of the range is 25 percent greater than a lower voltage of the range.

Item 16 includes a method of operating a band gap reference circuit including starting up the band gap reference circuit by providing current from a power supply to the band gap reference circuit, wherein during a first portion of the starting up, a startup circuit of the band gap reference circuit controls current from the power supply and an output of a band gap reference generator of the band gap reference circuit provides a voltage at its output; wherein the startup circuit does not control the current provided from the power supply after the voltage of the output rises above a first level during the starting up; during the starting up, providing a voltage differential between a body of a transistor of an inverter of the startup circuit and a source terminal of the transistor, wherein the inverter has an output used to deactivate the startup circuit from controlling the current from the power supply; and after the starting up, proving a reference voltage at the output. Item 17 includes the method of item 16 wherein the transistor is an N-channel transistor. Item 18 includes the method of item 17 wherein the inverter includes a second transistor connected in series with the transistor and being of an opposite conductivity type to the transistor, the transistor and the second transistor are coupled in series between a power supply terminal and ground, wherein a body of the second transistor is connected to a source of the second transistor. Item 19 includes the method of item 18 wherein during the starting up, the body of the transistor is biased to be in a range of 10-50% of a voltage of the power supply terminal. Item 20 includes the method of item 16 wherein the startup circuit includes a second inverter and a third inverter, wherein the inverter, the second inverter, and the third inverter are connected in series, wherein an input of a inverter located at the front of the series is coupled to the output of the band gap reference circuit.

What is claimed is:

1. A band gap reference circuit comprising:

a band gap reference generator including an output for providing a reference voltage;

a startup circuit for controlling current provided to the band gap reference generator when activated, wherein the startup circuit includes:

a turnoff circuit having an output to deactivate the startup circuit to not control current to the band gap reference generator based on a voltage of the output of the band gap reference generator, the turnoff circuit including an inverter coupled to a power supply voltage terminal and having a first transistor of a first conductivity type in series with a second transistor of a second conductivity type opposite the first conductivity type, and a second inverter coupled in series with the inverter, the second inverter coupled to the power supply voltage terminal and having a first transistor of the second conductivity type in series with a second transistor of the first conductivity type a body bias circuit connected to a body of the first transistor of the inverter to provide a voltage differential between the body of the first transistor of the inverter and a source terminal of the first transistor of the inverter which tracks the power supply voltage, wherein a body of the second transistor of the inverter is connected to a source of the second transistor of the inverter; and a second body bias circuit connected to a body of the first transistor of the second inverter to provide a voltage differential between the body and a source terminal of the first transistor of the second inverter which tracks the power supply voltage, wherein a body and a source terminal of the second transistor of the second inventor are connected.

2. The circuit of claim 1 wherein:

the first transistor of the inverter is an N-channel transistor having its source coupled to a ground terminal, wherein the body bias circuit is configured to bias the body of the first transistor of the inverter to be higher than ground during a startup operation of the band gap reference circuit; and the first transistor of the second inverter is a P-channel transistor having its source coupled to the power supply voltage terminal, wherein the second body bias circuit is configured to bias the body of the first transistor of the second inverter to be lower than the power supply voltage terminal during the startup operation of the band gap reference circuit.

3. The circuit of claim 1 wherein:

the first transistor of the inverter is a P-channel transistor having its source coupled to the power supply voltage terminal, wherein the body bias circuit is configured to bias the body of the first transistor of the inverter to be lower than the power supply voltage terminal during a startup operation of the band gap reference circuit; and the first transistor of the second inverter is an N-channel transistor having its source coupled to a ground terminal, wherein the body bias circuit is configured to bias the body of the first transistor of the second inverter to be higher than ground urinq the startup operation of the band gap reference circuit.

4. The circuit of claim 1 wherein the body bias circuit biases the body of the first transistor of the inverter to be different in voltage than a body of the second transistor of the inverter.

5. The circuit of claim 1 wherein the body bias circuit includes a voltage divider coupled between the power supply voltage terminal and a ground terminal, the voltage divider includes a divided voltage node coupled to the body of the first transistor of the inverter.

6. The circuit of claim 5 wherein the voltage divider includes a diode coupled between the divided voltage node and one of the power supply terminal and ground terminal.

7. The circuit of claim 5, wherein the second body bias circuit includes a second voltage divider coupled between the power supply voltage terminal and the ground terminal, the second voltage divider includes a divided voltage no de coupled to the body of the first transistor of the second inverter.

8. The circuit of claim 1 wherein the first transistor and the second transistor of the inverter are coupled in series between the power supply terminal and a ground terminal, wherein the body bias circuit is configured to bias the body of the first transistor of the inverter to be in a range of 10-90% of a voltage of the power supply terminal.

9. The circuit of claim 1 wherein the first transistor and the second transistor of the inverter are coupled in series between the power supply terminal and a ground terminal, wherein the body bias circuit is configured to bias the body of the first transistor of the inverter to be in a range of 10-50% of the voltage of the power supply terminal.

10. The circuit of claim 1 wherein the turnoff circuit includes a third inverter connected in series with the inverter and the second inverter, wherein an output of a last of the inverter, the second inverter, and the third inverter connected in the series is connected to the output of the turnoff circuit.

11. The circuit of claim 10 wherein the startup circuit further includes a third body bias circuit connected to a body of a third transistor of the third inverter to provide a voltage differential between the body of the third transistor and a source terminal of the third transistor.

12. The circuit of claim 1 wherein the first transistor of the inverter is a P-channel transistor having a source coupled to the power supply voltage terminal and the second transistor of the second inverter is a P-channel transistor having a source terminal coupled to the power supply voltage terminal.

13. The circuit of claim 1 wherein the first transistor of the inverter is an N-channel transistor having a source coupled to a second power supply voltage terminal that is less than the first power supply voltage terminal and the second transistor of the inverter is an N-channel transistor having a source terminal coupled to the second power supply voltage terminal.

14. The circuit of claim 1 wherein:

the startup circuit, when activated, controls current provided to the band gap reference generator from a power supply terminal;

the startup circuit is configured for the band gap reference circuit to be operable over a range of power supply terminal voltages of the power supply terminal; and for each power supply terminal voltage within the range of power supply terminal voltages, the band gap reference generator is configured to provide at its output a stable reference voltage at a first voltage and at a second voltage greater than the first voltage, wherein the body bias circuit is configured to bias the body of the first transistor and the second body bias circuit is configured to bias the body of the first transistor such that the startup circuit remains activated during a startup of the band gap reference circuit as the voltage of the output of the band gap reference generator rises through the first voltage and the start up circuit deactivates after the voltage of the output of the band gap reference generator is greater than the first voltage and remains deactivated as the voltage of the output reaches the second voltage.

15. The circuit of claim 14 wherein a higher voltage of the range is 25 percent greater than a lower voltage of the range.

16. A method of operating a band gap reference circuit comprising:

starting up the band gap reference circuit by providing current from a power supply to the band gap reference circuit, wherein during a first portion of the starting up, a startup circuit of the band gap reference circuit controls current from the power supply and an output of a band gap reference generator of the band gap reference circuit provides a voltage at its output, wherein the startup circuit includes a first inverter having a first transistor of a first conductivity type in series with a second transistor of a second conductivity type and a second inverter coupled in series with the first inverter and having a first transistor of the second conductivity type coupled in series with a second transistor of the first conductivity type, the first and second conductivity types being opposite conductivity types;

wherein the startup circuit does not control the current provided from the power supply after the voltage of the output rises above a first level during the starting up;

during the starting up, providing a voltage differential between a body of the first transistor of the inverter of the startup circuit and a source terminal of the first transistor of the inverter which tracks the power supply and providing a voltage differential between a body of the first transistor of the second inverter and a source terminal of the first transistor of the second inverter which tracks the power supply, wherein the second inverter has an output used to deactivate the startup circuit from controlling the current from the power supply, and wherein a body of a second transistor of the inverter is connected to a source terminal of the second transistor of the inverter, and a body of the second transistor of the second inverter is connected to a source terminal of the second transistor of the second inverter; and after the starting up, proving a reference voltage at the output.

17. The method of claim 16 wherein the first transistor of the inverter is an N-channel transistor, and the first transistor of the second inverter is a P-channel transistor having a source terminal coupled to receive a voltage of the power supply.

18. The method of claim 16 wherein wherein the first transistor of the inverter is a P-channel transistor having a source terminal coupled to receive a voltage of the power supply and the first transistor of the second inverter is an N-channel transistor.

19. The method of claim 17 wherein during the starting up, the body of the first transistor of the inverter is biased to be in a range of 10-50% of a voltage of the power supply.

20. The method of claim 16 wherein the startup circuit includes a third inverter, wherein the inverter, the second inverter, and the third inverter are connected in series, wherein an input of an inverter located at the front of the series is coupled to the output of the band gap reference circuit.

* * * * *